US007481149B2

(12) United States Patent
Hanne

(10) Patent No.: US 7,481,149 B2
(45) Date of Patent: Jan. 27, 2009

(54) BIMANUAL CONTROL VALVE

(75) Inventor: Hiroshi Hanne, Tsukubamirai (JP)

(73) Assignee: SMC Corporation, Tokyo (JP)

( * ) Notice: Subject to any disclaimer, the term of this patent is extended or adjusted under 35 U.S.C. 154(b) by 160 days.

(21) Appl. No.: 11/631,604

(22) PCT Filed: Jul. 4, 2005

(86) PCT No.: PCT/JP2005/012302

§ 371 (c)(1),
(2), (4) Date: Jan. 5, 2007

(87) PCT Pub. No.: WO2006/004079

PCT Pub. Date: Jan. 12, 2006

(65) Prior Publication Data

US 2007/0256741 A1 Nov. 8, 2007

(30) Foreign Application Priority Data

Jul. 6, 2004 (JP) ..... 2004-199545

(51) Int. Cl.
*F15B 13/04* (2006.01)

(52) U.S. Cl. ..... 91/424

(58) Field of Classification Search ..... 91/424, 91/425; 137/596.14, 596.16
See application file for complete search history.

(56) References Cited

U.S. PATENT DOCUMENTS

| | | | | |
|---|---|---|---|---|
| 2,974,637 A | | 3/1961 | Holmes et al. | |
| 3,047,017 A | * | 7/1962 | Brinkel | 91/424 |
| 3,552,266 A | | 1/1971 | Tanenblatt | |
| 4,706,548 A | * | 11/1987 | Baldauf et al. | 91/424 |
| 7,114,521 B2 | * | 10/2006 | Bento | 91/424 |

FOREIGN PATENT DOCUMENTS

| | | |
|---|---|---|
| JP | 47-11022 | 4/1972 |
| JP | 48-36295 | 5/1973 |
| JP | 49-100089 | 8/1974 |
| JP | 57-103908 | 6/1982 |
| JP | 57-103909 | 6/1982 |
| JP | 62-46011 | 2/1987 |
| JP | 4-309104 | 10/1992 |
| JP | 2001-56003 | 2/2001 |

* cited by examiner

*Primary Examiner*—Michael Leslie
(74) *Attorney, Agent, or Firm*—Oblon, Spivak, McClelland, Maier & Neustadt, P.C.

(57) ABSTRACT

In a control valve for use in both-hand operation provided with an AND valve (20) and a shuttle valve (21) connected to a main input ports (11*a* and 11*b*), a main switching valve (23) connected between the AND valve (20) and a main output port (12), and a tank (30) connected to an output port (21*b*) of the shuttle valve (21) through an aperture (26) in a valve body (10), valve holes of the AND valve (20), the shuttle valve (21), and the main switching valve (23) are pierced from an upper surface of the valve body (10), and a plate (33) for closing end portions of the valve holes and a cover (31) for forming the tank (30) are fixed in an airtight manner at the upper surface of the valve body (10), and continuous holes (33*a* and 33*b*) necessary for connecting the tank (30), the main switching valve (23), and the aperture (26) are pierced in the plate (33).

5 Claims, 8 Drawing Sheets

BIMANUAL CONTROL VALVE

TECHNICAL FIELD

The present invention relates to a control valve for use in both-hand operation, and more particularly to that used in a case of driving a fluid pressure driving device in which both hands of an operator have to be separated off from a dangerous area.

BACKGROUND ART

A control valve for use in both-hand operation is hitherto known as that used in a case that dangerousness of injury of hands by accident caused by a movement of the fluid pressure driving device is expected in operators who performs manual operation for the fluid pressure driving device.

That is, the control valve for use in both-hand operation is used in a case that, for example, both hands are required to be separated off from a dangerous area when an air pressure cylinder is started. In the control valve for use in both-hand operation, signal pressure is outputted to an output side, on the basis of both-side pressure of inputs supplied through press button valves when the separate press button valves are respectively operated by both left and right hands at approximately the same time, in concrete terms, within 0.5 second. Further, when a hand(s) is removed from one or both press button valve(s), the signal pressure to the output side is shut off at once, the drive for the air pressure cylinder, or the like in fluid pressure driving device driven by the signal pressure is stopped.

In recent years, simplification and miniaturization of a construction of various types of devices are required, and even in the control valve for use in both-hand operation performing such a movement as described above, the simplification and the miniaturization of a construction of an entire control valve are required. However, for achieving the miniaturization for the control valve for use in both-hand operation, since the control valve is constructed housing a number of valves provided with various functions in a valve body, not only each of the individual valves is required to be miniaturized, but also the valves have to be compactly housed in the valve body.

DISCLOSURE OF INVENTION

Problem to be Solved by the Invention

A technical problem of the present invention is to provide a control valve for use in both-hand operation, entire construction of which is enabled to be simple and miniaturized as well as possible.

Another technical problem of the present invention is to consider the miniaturization of each of the valves in the control valve for use in both-hand operation that is constructed upon housing a number of valves provided with various functions in a valve body, and at the same time, to form a miniaturized and compact-sized control valve for use in both-hand operation by means of an appropriate arrangement of the valves.

Still another technical problem of the present invention is to provide a control valve for use in both-hand operation enabled to manufacture and process the valve body with ease.

Means for Solving the Problems

To solve the above-described problems, a control valve for use in both-hand operation is characterized in that two manual operation valves to be operated by left and right hands are respectively connected to two main input ports of a valve body, and when the two manual operation valves are operated within a certain time, air pressure is outputted to a fluid pressure driving device from a main output port on the basis of an output of the manual operation valves, and an AND valve and a shuttle valve connected between both of main input ports by respectively connecting one of pairs of input ports to the aforementioned two main input ports, a main switching valve in which a valve input port is connected to an output port of the aforementioned AND valve, and a valve output port is connected to the aforementioned main output port, and a tank connected to an output port of the aforementioned shuttle valve through an aperture, in an inner part of the valve body, and a capacity of the tank is set such that a time until an internal pressure of the tank reaches a certain set pressure by compressed air flowing into the tank through the aforementioned aperture becomes equal to a time difference allowed for operation for the aforementioned two manual operation valves, and the pressure in the tank is applied to a valve member of the main switching valve and a communication between the valve input port of the main switching valve and the valve output port thereof is blocked by the set pressure, in which a cover for forming the aforementioned tank is fixed in an airtight manner at an upper surface of the aforementioned valve body, and the aforementioned AND valve, the shuttle valve, and each valve hole of the main switching valve, are opened from an upper surface of the valve body, and in which a plate for closing the valve holes is fixed to the upper surface of the valve body in an airtight manner, and a continuous hole for introducing the internal pressure of the aforementioned tank into a first pressure-receiving end surface of the valve member in the main switching valve and a continuous hole for allowing a flowing passage from the shuttle valve to communicate with the tank through the aperture are pierced in the plate.

In a preferred embodiment of the present invention, the control valve for use in both-hand operation is constructed as described below, in which the aforementioned main switching valve is formed of a spool-type valve, and the valve input port to which the compressed air is supplied from the AND valve, the valve output port outputting the compressed air to the aforementioned main output port from the switching valve, and a balancing pressure port for applying pressure of the compressed air in the valve output port to a second pressure-receiving end surface at opposite side of the aforementioned first pressure-receiving end surface of the valve member are opened in the valve hole, and a land for open and close a flowing passage connecting the aforementioned valve input port and the valve output port is provided in the spool-type valve member sliding in the valve hole, and a return spring is housed at the second pressure-receiving end surface side of the valve member in the aforementioned valve hole, and the aforementioned return spring moves the valve member to a tank side in a case that the pressure in the tank does not reach the set value, and thereby the valve member is held at a switching position for allowing the valve input port to communicate with the valve output port, while the valve member is pressed overcoming returning force of the aforementioned return spring, and the valve member is held at a switching position where the valve member blocks the flowing passage connecting the valve input port and the valve output port, when the pressure is accumulated in the tank exceeding the aforementioned set pressure, and is applied to the first pressure-receiving end surface of the valve member.

In this case, it is required for the valve member in the aforementioned spool-type main switching valve to be configured such that a seat diameter of a peripheral surface of each of both ends of the first and second pressure-receiving end surfaces is substantially identical of the seat diameter of the land, and thereby the pressure applied to the valve member in a direction of an axis line is balanced.

In another preferred embodiment of the present invention, the aforementioned two of main input ports are disposed in a manner to be lined in an above and below direction at a position in one-half of one side face of the valve body having approximately rectangular parallelepiped, and the aforementioned main output port, and an exhaust port that exhausts air pressure from the main output port are disposed at a position in the other-half of the one side face in a manner to be lined in an above and below direction, and the aforementioned AND valve and the shuttle valve are disposed at a backside of the aforementioned main input ports, and are allowed to communicate with a flowing passage led to the aforementioned main input ports, and the aforementioned switching vale is disposed to be positioned at a backside of the aforementioned main output port and the aforementioned exhaust port in a manner so as to be lined with the AND valve.

Further, still another preferred embodiment of the present invention is constructed as described below, in which the valve output port of the aforementioned main switching valve is allowed to communicate with the main output port through an exhaust flowing passage of a rapid exhaust valve having a checking function, and the exhaust valve member of the aforementioned rapid exhaust valve is formed of a rubber elastic material, and a checking function portion is provided at a periphery of the exhaust valve member, and seat portions that contact with or separate from an exhaust valve seat led to the aforementioned exhaust port and an exit valve seat led to the valve output port of the aforementioned main switching valve are provided at both end faces of the exhaust valve member, and when output pressure exists in the valve output port of the aforementioned main switching valve, the exhaust valve member is brought to be in contact with an exhaust valve seat side with pressure and one of seat portions thereof closes the exhaust valve seat, and the output of the aforementioned valve output port flows out through the checking function portion, and is outputted to the main output port through the aforementioned exhaust flowing passage, and when the output pressure does not exist in the aforementioned valve output port, the exhaust valve member is brought to be in contact with the exit valve seat side with pressure and the aforementioned exhaust valve seat is released, and the compressed air in the main output port is rapidly exhausted from the exhaust port through the aforementioned exhaust flowing passage.

REFERENCE NUMERALS

Figure 1:
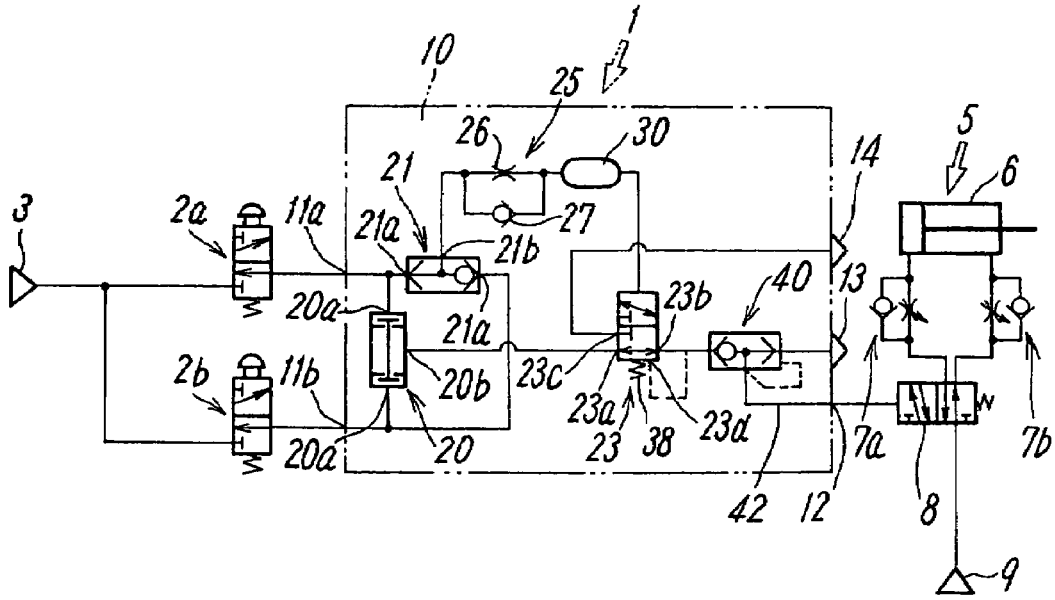
FIG. 1 is a block construction view of a basic circuit in a case of using a control valve for use in both-hand operation with respect to the present invention for a drive of a fluid pressure driving device.

1 control valve for use in both-hand operation
2*a*, 2*b* manual operation valve
3 air pressure source
5 fluid pressure driving device
6 air pressure cylinder
7*a*, 7*b* speed controller
8 switching valve
9 pressure supplying source
10 valve body
11*a*, 11*b* main input port
12 main output port
13 exhaust port
14 ventilation port
15 tube joint
20 AND valve
20*a* input port
20*b* output port
21 shuttle valve (OR valve)
21*a* input port
21*b* output port
23 main switching valve
23*a* valve input port
23*b* valve output port
23*c* residual pressure discharging port
23*d* balancing pressure port
25 flowing amount control element
26 aperture
27 check valve
30 tank
31 cover
33 plate
33*a*, 33*b* communication hole
35 valve member
35*a* first pressure-receiving end surface
35*b* second pressure-receiving end surface
36 valve hole
37*a*, 37*b* land
38 return spring
40 rapid exhaust valve
41 exhaust valve member
41*a* checking function portion
41*b*, 41*c* seat portion
42 exhaust flowing passage
43 exhaust valve seat
44 exit valve seat

BEST MODE FOR CARRYING OUT THE INVENTION

Hereinbelow, an embodiment of the present invention will be explained in detail on the bases of the drawings.

FIG. 1 is showing a construction of a basic circuit in a case of using a control valve for use in both-hand operation with respect to the present invention for driving a fluid pressure driving device. In the basic circuit, a control valve 1 for use in both-hand operation with respect to the present invention is provided, and two manual operation valves (in concrete terms, press button valve having three ports), 2*a* and 2*b*, to be individually operated with left and right hands are connected thereto, and further, a fluid pressure driving device 5 operated on the basis of an output of the aforementioned control valve 1 for use in both-hand operation is provided. The aforementioned manual operation valves, 2*a* and 2*b*, supply compressed air from an air pressure source 3 to the control valve 1 for use in both-hand operation by means of pressing operation for a press button at a head portion thereof, and discharge the compressed air sent to the control valve 1 toward outside, when the press button is released.

As the aforementioned fluid pressure driving device 5, an air pressure cylinder 6 that drives various types of devices, a pair of speed controller, 7*a* and 7*b*, which controls driving speed of a reciprocating movement of the air pressure cylinder 6, a switching valve 8 driven by air pressure, which controls driving operation of the aforementioned air pressure cylinder 6 on the basis of output of the aforementioned control valve 1 for use in both-hand operation, a pressure supplying source 9 that supplies compressed air to the air pressure cylinder 6 through the switching valve 8 are shown here. The switching valve 8 is constructed as a five-port valve that drives the air pressure cylinder 6 in a direction where dangerousness exists during the time the output pressure of the control valve 1 for use in both-hand operation, serving as pilot fluid pressure, is supplied, and when the output pressure of the control valve 1 is reduced, returns the air pressure cylinder 6 to a side of safeness. However, the switching valve 8 is not limited to have such a construction, and various types of structures that appropriately drives the fluid pressure driving device 5 and stops the device at once at the side of safeness when the output pressure of the control valve 1 is reduced can be adopted.

Figure 2:
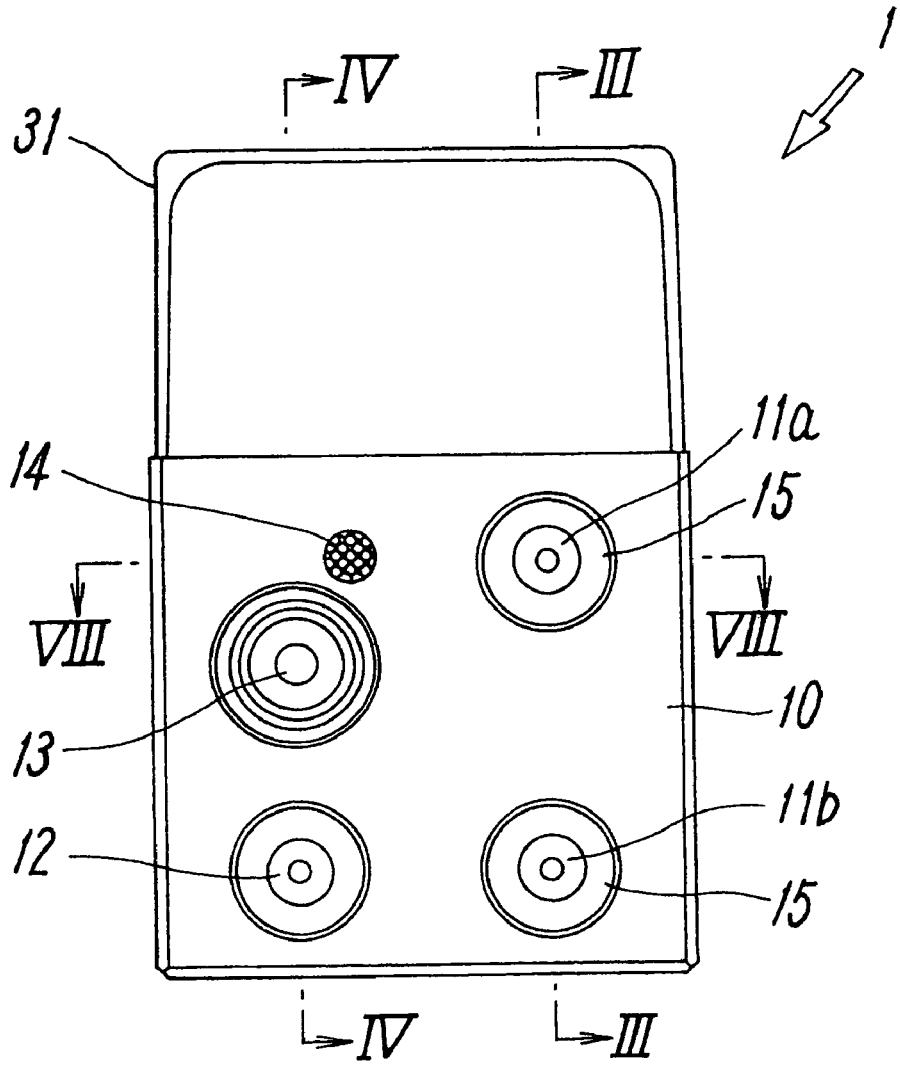
FIG. 2 is an elevation showing an embodiment of the control valve for use in both-hand operation with respect to the present invention.

The aforementioned control valve 1 for use in both-hand operation is provided with two main input ports, 11*a* and 11*b*, for individually connecting the aforementioned two three-port manual operation valves, 2*a* and 2*b*, in a valve body 10, as shown in FIG. 1. The main input ports, 11*a* and 11*b*, are disposed in a manner to be lined in an above and below direction at a position in one-half of one side face of the valve body 10 having approximately rectangular parallelepiped, as is clear from FIGS. 2 and 3, are respectively provided with a tube joint 15 attached thereto.

Further, at a position in the other-half of the one side face of the aforementioned valve body 10 where the aforementioned main input ports, 11*a* and 11*b*, are disposed, a main output port 12 that outputs signal pressure (air pressure) to the switching valve 8 of the fluid pressure driving device 5, and an exhaust port 13 that exhausts air pressure that is being supplied to the switching valve 8 are disposed in a manner to be lined in an above and below direction, as is clear from FIGS. 2 and 4. Furthermore, a ventilation port 14 that is allowed to communicate with a residual pressure discharging port 23*c* of a main switching valve 23, described later is opened.

The aforementioned main output port 12 is a port which outputs air pressure as pilot fluid pressure to the switching valve 8 of the fluid pressure driving device 5, when compressed air is supplied to both the main input ports, 11*a* and 11*b*, from both of the operation valves, 2*a* and 2*b*, approximately at the same time. The aforementioned exhaust port 13 is a port which discharges the air pressure that is being supplied to the switching valve 8, when the compressed air is not supplied to the main input ports from at least one of both the manual operation valves, 2*a* and 2*b*, namely both of the main input ports, 11*a* and 11*b*, are brought to a state that the compressed air is not supplied thereto.

Figure 3:
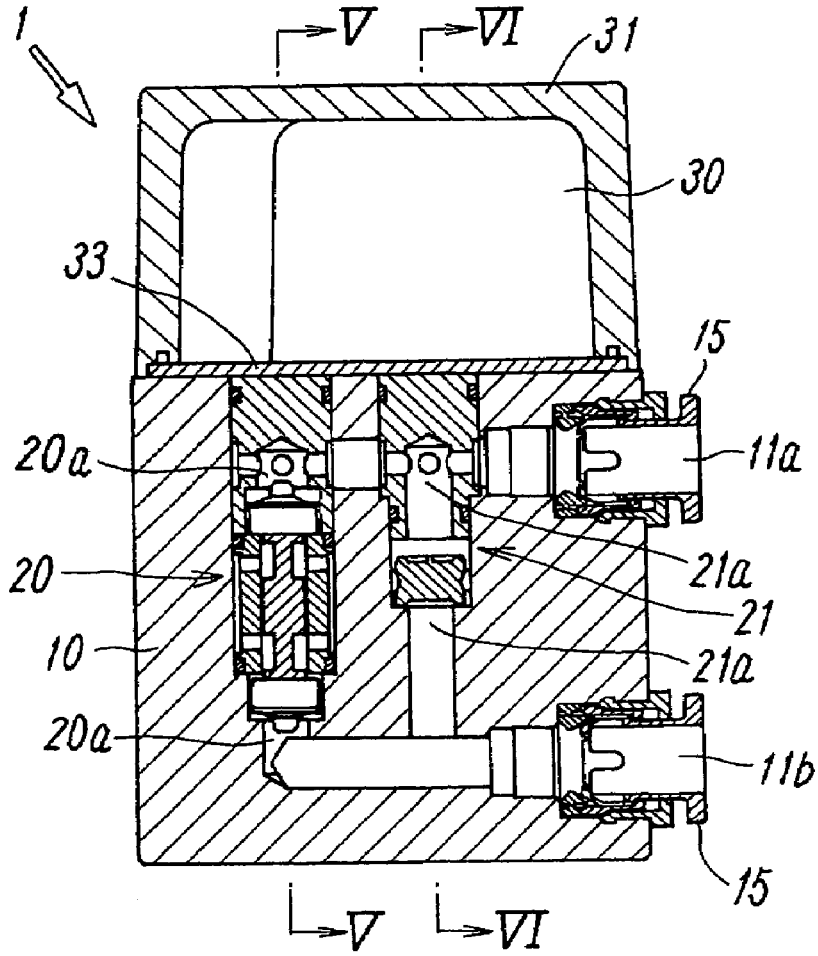
FIG. 3 is a cross-section along III-III line in FIG. 2.

When the construction of the aforementioned control valve 1 in se for use in both-hand operation is further concretely explained, firstly, as shown in FIGS. 1 and 3, in the aforementioned valve body 10, a pair of input ports, 20*a* and 20*a*, of the AND valve 20, and a pair of input ports, 21*a* and 21*a*, of the shuttle valve (OR valve) 21 are respectively connected to a pair of flowing passage to be led to both the aforementioned main input ports, 11*a* and 11*b*. Thereby, the AND valve 20 and the shuttle valve 21 are connected to a portion between both of the aforementioned main input ports, 11*a* and 11*b*, in parallel with each other. The aforementioned AND valve 20 is a valve that outputs compressed air as an AND output from an output port 20*b* (refer to FIGS. 1 and 5), only in a case that the compressed air is inputted to both of the pair of input ports, 20*a* and 20*a*. On the other hand, the aforementioned shuttle valve 21 is a valve that outputs inputted compressed air from an output port 21*b* (refer to FIGS. 1 and 6) as an OR output in a case that the compressed air is inputted in at least one side of the pair of input ports, 21*a* and 21*a*.

The aforementioned AND valve 20 and the OR valve 21 are disposed at a backside of the main input ports, 11*a* and 11*b*, connected to the aforementioned manual operation valves, 2*a* and 2*b*, at one side face of the valve body 10, facing each of axis lines in a direction in which the main input ports, 11*a* and 11*b*, are disposed, namely in a condition in parallel with an above and below direction of the drawing, and are allowed to communicate with the flowing passage led to the aforementioned main input ports, 11*a* and 11*b*. More in concrete, a valve hole is pierced from an upper surface of the valve body 10 at a backside position of the aforementioned main input ports, 11*a* and 11*b*, and valve mechanisms of the AND valve 20 and that of the shuttle valve 21 are housed in the valve hole. A connecting operation for each of the pair of input ports, 20*a* and 20*a*, in the AND valve 20, and the pair of input ports, 21*a* and 21*a*, in the shuttle valve 21, and the aforementioned main input ports, 11*a* and 11*b*, are performed by means of allowing a hole pierced in an inner back of the main input ports, 11*a* and 11*b*, to communicate with valve holes of the aforementioned AND valve 20 and the shuttle valve 21.

Figure 5:
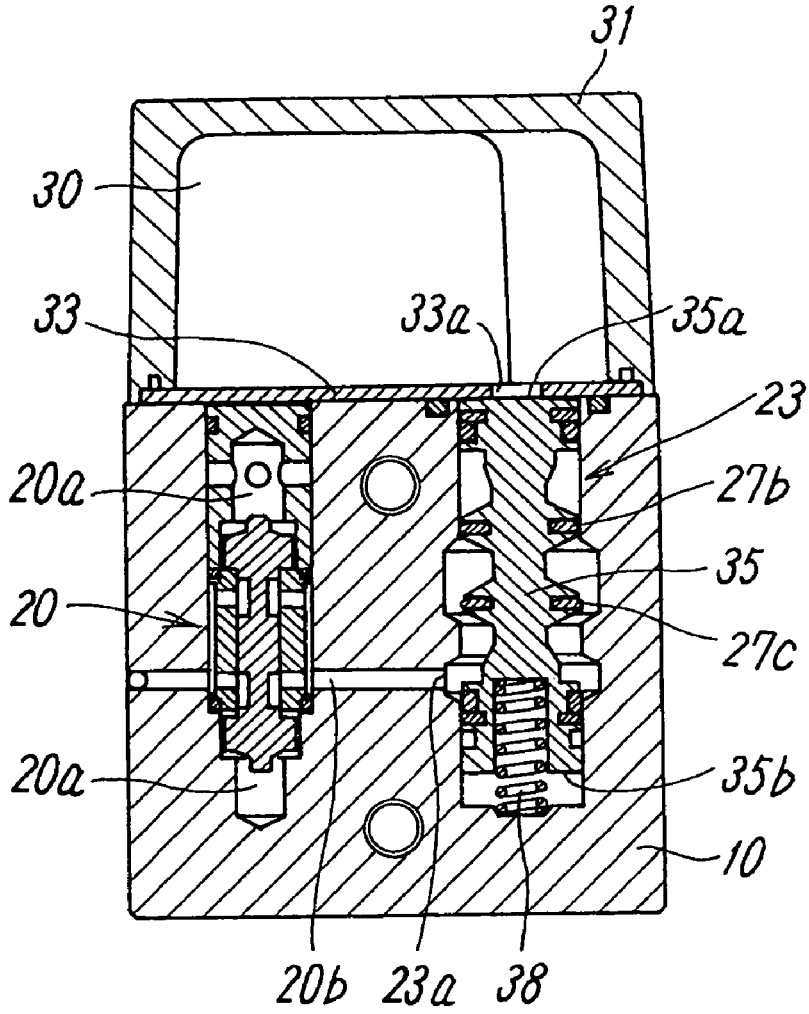
FIG. 5 is a cross-section along V-V line in FIG. 3.
Figure 6:
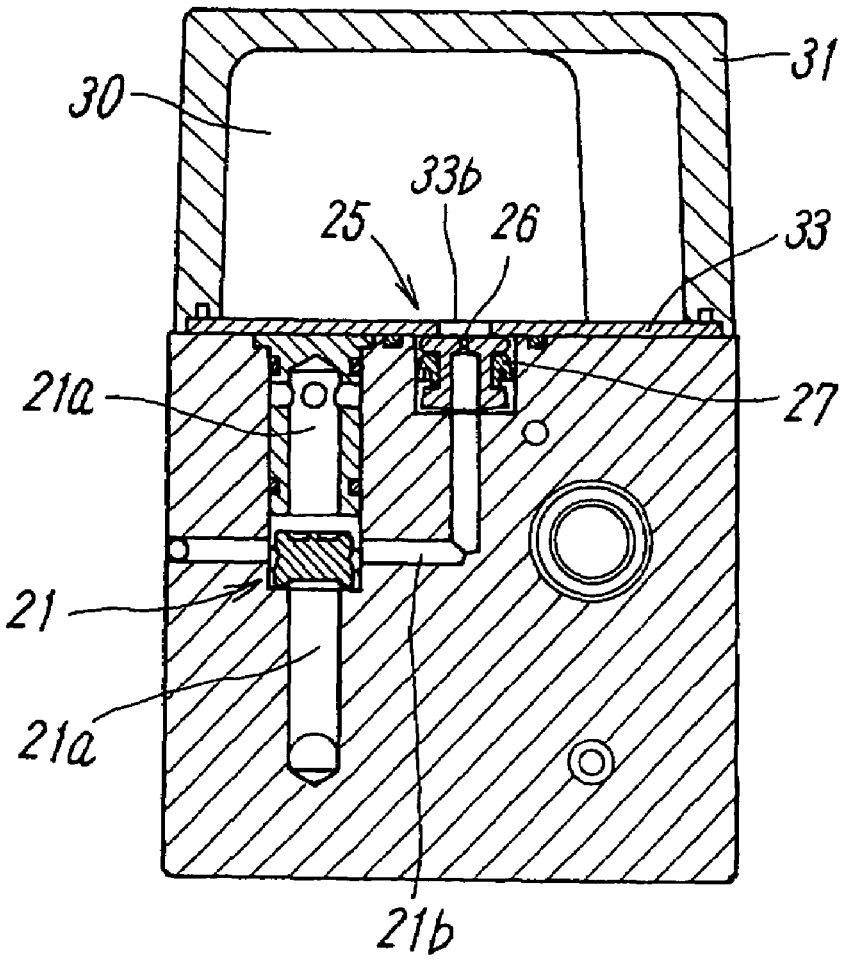
FIG. 6 is a cross-section along VI-VI line in FIG. 3.

Further, the output port 20*b* of the aforementioned AND valve 20 is connected to a valve input port 23*a* of the main switching valve 23, as shown in FIGS. 1 and 5. On the other hand, the output port 21*b* of the aforementioned shuttle valve 21 is connected to a tank 30 on the valve body 10 through a flowing amount control element 25 where an aperture 26 and a check valve 27 are connected in parallel therewith, as shown in FIGS. 1 and 6.

The tank 30 is a tank whose capacity is set such that a time for internal pressure of the tank 30 to reach a certain pressure by the compressed air that flows therein through the aforementioned flowing amount control element 25 equals a time difference allowed for the operation for two of the manual operation valves, 2*a* and 2*b* performed with both hands. The pressure in the tank 30 is configured to be applied to a first pressure-receiving end surface 35*a* of a valve member 35 so that the valve member (spool valve) 35 in a spool-type main switching valve 23 is driven, as shown in FIGS. 1, 4, and 5.

Figure 4:
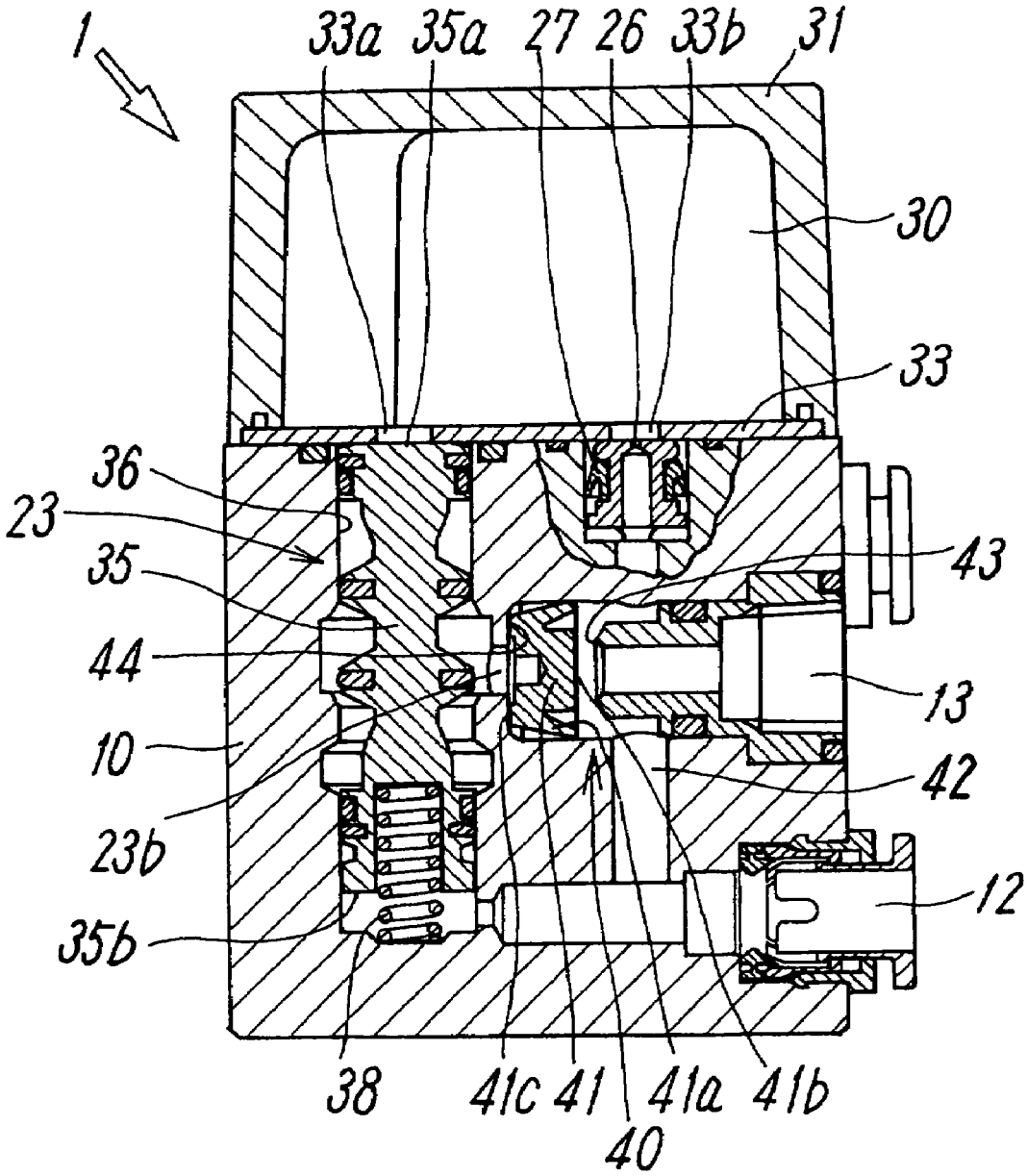
FIG. 4 is a cross-section along IV-IV line in FIG. 2.
Figure 7:
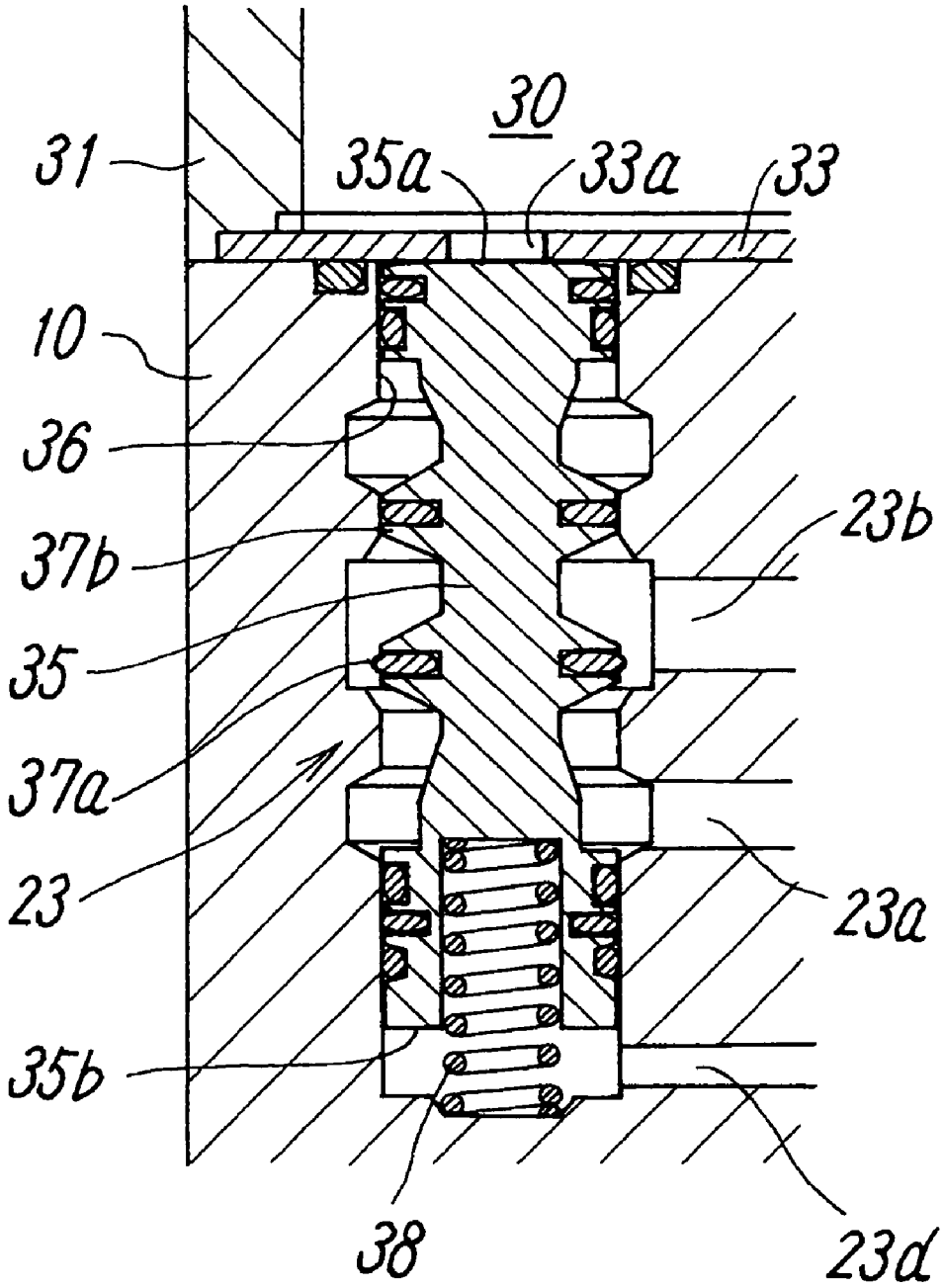
FIG. 7 is a schematic enlarged longitudinal cross-section of a spool-type main switching valve in a valve body.

The aforementioned spool-type main switching valve 23 is constructed by piercing a valve hole 36 from an upper surface of the valve body 10 to be positioned in parallel with the AND valve 20 at the backside of the aforementioned main output port 12 and the aforementioned exhaust port 13, and by inserting the aforementioned valve member 35 of a spool type into the valve hole 36, as is clear from FIGS. 4, 5, and 7, and the internal pressure of the tank 30 at the upper surface of the valve body 10 is configured to be applied to the first pressure-receiving end surface 35*a* at an end portion of the valve member 35 for driving the valve member 35. Since the valve hole 36 of the spool-type main switching valve 23 is formed at the aforementioned position, the output port 20*b* of the AND valve 20 can be allowed to straightly communicate with the valve input port 23*a* of the main switching valve 23 with ease, as shown in FIG. 5.

The aforementioned tank 30 is a tank formed by means of joining a cover 31 on the valve body 10 therein, as is clear from FIGS. 3 through 6. However, at the upper surface of the valve body 10 facing the tank 30, various types of valve holes are formed, as is clear from the drawings, and therefore, a plate 33 for closing the valve holes with a partial exception is mounted on and fixed to the upper surface of the valve body 10 in an air tight manner so as to form the aforementioned tank 30. Further, a continuous hole 33*a* is formed at a position corresponding to the aforementioned valve hole 36 so as to introduce the internal pressure of the aforementioned tank 30 to the pressure-receiving surface 35*a* of the valve member 35 in the main switching valve 23. Furthermore, a continuous hole 33*b* is pierced at a position corresponding to the aperture 26 and the check valve 27 so as to allow the flowing passage from the aforementioned shuttle valve 21 to communicate with the tank 30 through the flowing amount control element 25 including the aperture 26 and the check valve 27.

Figure 8:
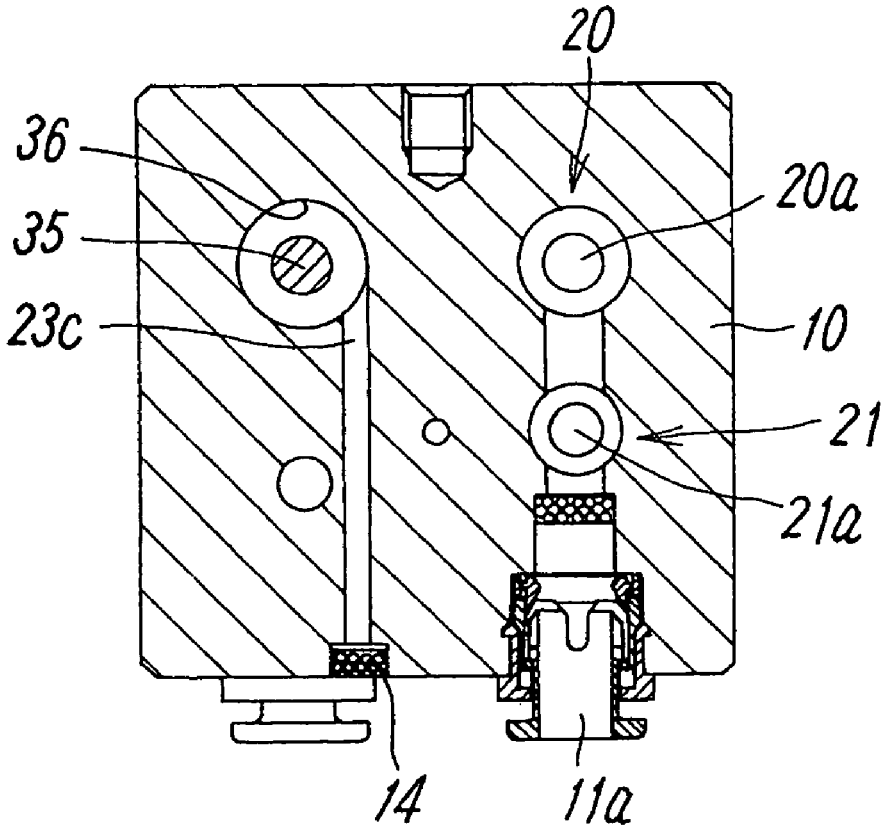
FIG. 8 is a cross-section along VIII-VIII line in FIG. 2.

In the aforementioned spool-type main switching valve 23, as clearly shown in FIG. 7, the valve input port 23*a* (also refer to FIG. 5) into which the compressed air from the aforementioned AND valve 20 is supplied, a valve output port 23*b* (also refer to FIG. 4) that outputs air pressure to the switching valve 8 of the fluid pressure driving device 5 from the main switching valve 23 through the main output port 12 of the valve body 10, the residual pressure discharging port 23*c* (refer to FIGS. 1 and 8) for discharging the residual pressure remaining in the valve output port 23*b* side when the flowing passage from the valve input port 23*a* to the valve output port 23*b* is closed, and a balancing pressure port 23*d* for applying the pressure of the compressed air in the valve output port 23*b* to a second pressure-receiving end surface 35*b* opposite side to the aforementioned first pressure receiving end surface 35*a* of the valve member 35 are pierced at the valve hole 36. Further, a land 37*a* made of sealing member for opening and closing the flowing passage connecting the valve input port 23*a* and the valve output port 23*b*, and a land 37*b* also made of sealing member for allowing the valve output port 23*b* to communicate with the residual pressure discharging port 23*c* when the flowing passage between the valve input port 23*a* and the valve output port 23*b* is closed by the aforementioned land 37*a* are provided in the valve member (spool) 35 sliding in an inner part of the valve hole 36.

Furthermore, a return spring 38 is housed at side of the second pressure-receiving end surface 35*b* of the valve member 35 in the aforementioned valve hole 36, and repulsion force of the return spring 38 is applied to the valve member 35. A strength of the repulsion force of the return spring 38 is configured such that the valve member 35 is pressed overcoming repulsion force of the aforementioned return spring 28 when the pressure is accumulated in the aforementioned tank 30 exceeding a certain set pressure and applied to the pressure-receiving end surface 35*a* of the valve member 35, the valve member 35 is held at a position where the land 37*a* blocks an area between the valve input port 23*a* and the valve output port 23*b*, while the valve member 35 is held in a condition to be moved to a side of the tank 30, in a case that the compressed air is not filled in the tank 30 through the aforementioned aperture 26, or that the pressure of the compressed air does not reach a certain set pressure, and thereby the valve member 35 is held at a switching position of FIG. 7 where the valve input port 23*a* is allowed to communicate with the valve output port 23*b*. In addition, in a case that the output pressure of the valve output port 23*b* is introduced into the balancing pressure port 23*d*, it is natural the valve member 35 is held at a position shown in FIG. 7.

The valve member 35 in the aforementioned spool-type main switching valve 23 is configured such that a seat diameter of a peripheral surface of the sides of the pressure-receiving end surfaces 35*a* and 35*b* at both sides of the valve member 35, and the seat diameters of the lands, 37*a* and 37*b*, are formed to be substantially the same so as for the valve member 35 to be moved while balancing the pressure to be applied thereto in a direction of an axis line. However, when the spool-type main switching valve 23 having the valve member 35 with thus balanced pressure is used, the valve hole 36 can be miniaturized compared to a case using a switching valve, such as, for example, a poppet valve, or the like that is hard to balance the pressure, and as a result, the valve body 10 can be miniaturized. Specifically, the miniaturization for the aforementioned valve hole 36 is effective for the miniaturization for the valve body 10 in a case that each of the valve holes of the AND valve 20, shuttle valve 21, and the main switching valve 23, is pierced in a parallel manner from the upper surface of the valve body 10, as in the aforementioned control valve 1 for use in both-hand operation.

As shown in FIG. 4, the valve output port 23*b* of the aforementioned main switching valve 23 is allowed to communicate with the main output port 12 through an exhaust flowing passage 42 of the rapid exhaust valve 40 having a checking function, and further, when the output pressure does not exist in the aforementioned valve output port 23*b*, the main output port 12 is allowed to communicate with the exhaust port 13 through the aforementioned exhaust flowing passage 42.

In more concrete explanation, an exhaust valve member 41 of the rapid exhaust valve 40 is formed of a rubber elastic material, and includes a fin-like checking function portion 41*a* around a periphery thereof, and seat portions, 41*b* and 41*c* at both faces. In the seat portions, 41*b* and 41*c*, the seat portion 41*b* contacts with or separates from the exhaust valve seat 43 positioned inside the aforementioned exhaust port 13, and similarly, the seat portion 41*c* contacts with or separates from an exit valve seat 44 positioned at an outside of the valve output port 23*b* of the aforementioned main switching valve 23*b* and facing the aforementioned exhaust valve seat 43.

Accordingly, when the output pressure exists in the valve output port 23*b* of the aforementioned main switching valve 23, the exhaust valve member 41 is thereby brought to be in contact with the exhaust valve seat 43 side with pressure, and the seat portion 41*b* closes the exhaust valve seat 43, and the output of the aforementioned valve output port 23*b* presses the checking function portion 41*a* at the periphery of the exhaust valve member 41 and flows out therefrom, and further, outputted to the main output port 12 passing through the exhaust flowing passage 42. Furthermore, when the output pressure does not exist in the aforementioned valve output port 23*b*, and compressed air exists at the main output port 12 side, the exhaust valve member 41 is brought to be in contact with the exit valve seat 44 side with pressure. Thereby, the aforementioned exhaust valve seat 43 is opened and at the same time, the output valve seat 44 is closed by the seat portion 41*c* of the exhaust valve member 41. As a result, the compressed air in the main output port 12 is rapidly exhausted from the exhaust port 13 through the aforementioned exhaust flowing passage 42.

In the control valve 1 for use in both-hand operation, when the operator takes off his or her hand from at least one of the manual operation valves, the compressed air that is being outputted from the main output port 12 is required to be rapidly exhausted so that the fluid pressure driving device 5 is stopped at once or is brought to a safe condition. However, since the exhaust port 13 is provided in the positional relationship described above, the same can be formed to have a large diameter. However, the valve body 10 is not caused to be large-sized resulting from forming the exhaust port 13 to have a large diameter.

Next, the operation of the control valve 1 for use in both-hand operation having the construction described above will be explained.

In the aforementioned control valve 1 for use in both-hand operation, when one of the manual operation valves 2*a* or 2*b* in FIG. 1 is pressed, the compressed air from the air pressure source 3 flows into the pair of input ports, 20*a* and 20*a*, of the AND valve 20, and the pair of input ports, 21*a* and 21*a*, of the shuttle valve 21, from the main input ports, 11*a* or 11*b*, of the valve body 10. In a case that only one side of the manual operation valves, 2*a* or 2*b*, is pressed, although the output from the AND valve 20 does not exist, the output from the output port 21*b* of the shuttle valve 21 exists, the output from the output port 21*b* flows into the tank 30 through the aperture 26, and accumulated in the tank 30. A bore diameter of the aforementioned aperture 26 and the capacity of the tank 30 are adjusted such that the internal pressure of the tank 30 reaches a set pressure applied to the pressure-receiving end surface 35*a* of the valve member 35 in the spool-type main switching valve 23 in more or less 0.5 second.

When the other of the manual operation valves, 2*b* or 2*a*, is pressed before the internal pressure of the aforementioned tank 30 reaches the set pressure, the compressed air flows into both the input ports, 20*a* and 20*a*, of the AND valve 20, and thereby an output is generated at the output port 20*b* of the AND valve 20 and reaches the valve input port 23*a* of the main switching valve 23. On the other hand, since the internal pressure of the aforementioned tank 30 has not reached until the set pressure at this moment, the main switching valve 23 is at a switching position shown in FIGS. 1 and 7. That is, the valve input port 23*a* of the main switching valve 23 is in a switching condition of being communicated with the valve output port 23*b*. As a result, the compressed air outputted to the aforementioned valve output port 23*b* flows out while pushing open the checking function portion 41*a* at the periphery of the exhaust valve member 41 of the rapid exhaust valve 40, and is outputted to the main output port 12 through the exhaust flowing passage 42 and sent to the fluid pressure driving device 5.

Incidentally, even when the output from the shuttle valve 21 is accumulated to the tank 30 through the aperture 26, and reaches a set pressure, the valve member 35 cannot be switched by the pressure in the aforementioned tank 30. This is because, when the compressed air reaches the valve output port 23*b* from the valve input port 23*a* of the main switching valve 23, the compressed air flows into the balancing pressure port 23*d* and is applied to the second pressure-receiving end surface 35*b* of the valve member 35.

In a case that the aforementioned other of the manual operation valve is not pressed until the internal pressure of the aforementioned tank 30 reaches the set pressure, the internal pressure of the tank 30 is applied to the first pressure-receiving end surface 35*a* of the valve member 35 in the main switching valve 23, and the valve member 35 is switched by overcoming the returning force of the return spring 38 at the other end of the valve member 35. As a result, since the switching condition is configured such that the communication of the valve input port 23*a* of the switching valve 23 with the valve output port 23*b* thereof is blocked, even when the manual operation valve is pressed thereafter, the compressed air cannot be outputted to the fluid pressure driving device 5 through the main switching valve 23.

Further, when at least one of the aforementioned manual operation valves, 2*a* and 2*b*, is released by taking off the hand therefrom in a condition that the compressed air is supplied to the fluid pressure driving device 5 by pressing both the manual operation valves, 2*a* and 2*b*, the output from the AND valve disappears. Therefore, the pressure applied to the second pressure-receiving end surface 35*b* of the valve member 35 through the balancing pressure port 23*d* at the spool-type main switching valve 23 is reduced. In addition, since sufficient pressure is accumulated in the tank 30 at that moment, the valve member 35 of the main switching valve 23 is switched, and the communication between the valve input port 23*a* of the switching valve 23 and the valve output port 23*b* thereof is blocked.

Further, when the hands are taken off from both of the aforementioned manual operation valves, 2*a* and 2*b*, the compressed air from the air pressure source 3 is blocked at these valves. On the other hand, the compressed air accumulated in the tank 30 is discharged from either one of the manual operation valves, 2*a* and 2*b*, through the check valve 27 and the shuttle valve 21.

The invention claimed is:

1. A control valve for use in both-hand operation, wherein two manual operation valves (2*a* and 2*b*) to be operated by left and right hands are respectively connected to two main input ports (11*a* and 11*b*) of a valve body (10), and when the two manual operation valves (2*a* and 2*b*) are operated within a certain time, air pressure is outputted to a fluid pressure driving device (5) from a main output port (12) of the valve body (10) on the basis of an output of the manual operation valves (2*a* and 2*b*), comprising:

an AND valve (20) and a shuttle valve (21) connected between both of main input ports (11*a* and 11*b*) by respectively connecting one of pairs of input ports (20*a* and 20*a*/21*a* and 21*a*) to the two main input ports (11*a* and 11*b*);

a main switching valve (23) wherein a valve input port (23*a*) is connected to an output port (20*b*) of the AND valve (20), and a valve output port (23*b*) is connected to the main output port (12); and a tank (30) connected to an output port (21*b*) of the shuttle valve (21) through an aperture (26), in an inner part of the valve body, wherein a capacity of the tank (30) is set such that a time until an internal pressure of the tank (30) reaches a certain set pressure by compressed air flowing into the tank (30) through the aperture (26) becomes equal to a time difference allowed for operation for the two manual operation valves (2*a* and 2*b*), and wherein the pressure in the tank (30) is applied to a valve member (35) of the main switching valve (23) and a communication between the valve input port (23*a*) of the main switching valve (23) and the valve output port (23*b*) thereof is blocked by the set pressure, wherein a cover (31) for forming the tank (30) is fixed in an airtight manner at an upper surface of the valve body (10), and the AND valve (20), the shuttle valve (21), and each valve hole (36) of the main switching valve (23), are opened from the upper surface of the valve body (10), and wherein a plate (33) for closing the valve hole (36) is fixed to an upper surface of the valve body (10) in an airtight manner, and a continuous hole (33*a*) for introducing the internal pressure of the tank (30) into a first pressure-receiving end surface (35*a*) of the valve member (35) in the main switching valve (23) and a continuous hole (33*b*) for allowing a flowing passage from the shuttle valve (21) to communicate with the tank (30) through the aperture (26) are pierced in the plate (33).

2. The control valve for use in both-hand operation according to claim 1, wherein the main switching valve (23) is formed of a spool-type valve, and wherein the valve input port (23*a*) to which the compressed air is supplied from the AND valve (20), the valve output port (23*b*) outputting the compressed air to the main output port (12) from the switching valve, and a balancing pressure port (23*d*) for applying pressure of the compressed air in the valve output port (23*b*) to a second pressure-receiving end surface (35*b*) at opposite side of the first pressure-receiving end surface (35*a*) of the valve member (35) are opened in the valve hole (36) of the main switching valve (23), and wherein a land (37*a*) for open and close a flowing passage connecting the valve input port (23*a*) and the valve output port (23*b*) is provided in the spool-type valve member (35) sliding in the valve hole (36), and wherein a return spring (38) is housed at the second pressure-receiving end surface (35*b*) side of the valve member (35) in the valve hole (36), and the return spring (38) moves the valve member (35) to a tank (30) side in a case that the pressure in the tank (30) does not reach the set value, and thereby the valve member (35) is held at a switching position for allowing the valve input port (23*a*) to communicate with the valve output port (23*b*), while the valve member (35) is pressed overcoming returning force of the return spring (38), and the valve member (35) is held at a switching position where the valve member (35) blocks the flowing passage connecting the valve input port (23*a*) and the valve output port (23*b*), when the pressure is accumulated in the tank (30) exceeding the set pressure, and is applied to the first pressure-receiving end surface (35*a*) of the valve member (35).

3. The control valve for use in both-hand operation according to claim 2, wherein the valve member (35) in the spool-type main switching valve (23) is configured such that a seat diameter of a peripheral surface of each of both ends of the pressure-receiving end surfaces (35*a* and 35*b*) is substantially identical of the seat diameter of the land (37*a*), and thereby the pressure applied to the valve member (35) in a direction of an axis line is balanced.

4. The control valve for use in both-hand operation according to either one of claims 1 or 2, wherein two of main input ports (11*a* and 11*b*) are disposed in a manner to be lined in an above and below direction at a position in one-half of one side face of the valve body (10) having approximately rectangular parallelepiped, and the main output port (12), and an exhaust port (13) that exhausts air pressure from the main output port (12) are disposed at a position in the other-half of the one side face in a manner to be lined in an above and below direction, and wherein the AND valve (20) and the shuttle valve (21) are disposed at a backside of the main input ports (11*a* and 11*b*), and are allowed to communicate with a flowing passage led to the main input ports (11*a* and 11*b*), and wherein the switching vale (23) is disposed to be positioned at a backside of the main output port (12) and the exhaust port (13) in a manner so as to be lined with the AND valve.

5. A control valve for use in both-hand operation according to either one of claims 1 or 2, wherein the valve output port (23*b*) of the main switching valve (23) is allowed to communicate with the main output port (12) through an exhaust flowing passage (42) of a rapid exhaust valve (40) having a checking function, and wherein the exhaust valve member (41) of the rapid exhaust valve (40) is formed of a rubber elastic material, and a checking function portion (41*a*) is provided at a periphery of the exhaust valve member (41), and seat portions (41*b* and 41*c*) that contact with or separate from an exhaust valve seat (43) led to the exhaust port (13) and an exit valve seat (44) led to the valve output port (23*b*) of the main switching valve (23) are provided at both end faces of the exhaust valve member (41), and wherein when output pressure exists in the valve output port (23*b*) of the main switching valve (23), the exhaust valve member (41) is brought to be in contact with an exhaust valve seat (43) side with pressure and one of seat portions (41*b*) thereof closes the exhaust valve seat (43), and the output of the valve output port (23*b*) flows out through the checking function portion (41*a*), and is outputted to the main output port (12) through the exhaust flowing passage (42), and wherein when the output pressure does not exist in the valve output port (23*b*), the exhaust valve member (41) is brought to be in contact with the exit valve seat (44) side with pressure and the exhaust valve seat (43) is released, and the compressed air in the main output port (12) is rapidly exhausted from the exhaust port (13) through the exhaust flowing passage (42).

* * * * *